United States Patent [19]

Chou

[11] Patent Number: 4,697,828

[45] Date of Patent: Oct. 6, 1987

[54] WELLHEAD BODY LOCKDOWN AND METHOD FOR ENGAGING SAME

[75] Inventor: Yung-Sen Chou, Houston, Tex.

[73] Assignee: Armco Inc., Middletown, Ohio

[21] Appl. No.: 935,462

[22] Filed: Nov. 26, 1986

[51] Int. Cl.[4] ..... F16L 55/00

[52] U.S. Cl. ..... 285/18; 285/39; 285/141

[58] Field of Search ..... 285/18, 39, 141, 321, 285/162

[56] References Cited

U.S. PATENT DOCUMENTS

| | | | |
|---|---|---|---|
| 3,807,497 | 4/1974 | Baugh | 285/18 X |
| 3,986,729 | 10/1976 | Taylor | 285/18 |
| 4,465,134 | 8/1984 | Watkins | 285/39 X |
| 4,496,172 | 1/1985 | Walker | 285/18 |
| 4,515,400 | 5/1985 | Smith et al. | 285/141 |

*Primary Examiner*—Richard J. Scanlan, Jr.

*Attorney, Agent, or Firm*—R. J. Bunyard; R. H. Johnson; L. A. Fillnow

[57] ABSTRACT

Preloaded connection for supporting an annular body from an annular suspension joint. The connection includes an actuating ring, a split locking ring and a retaining nut which are positioned between the annular body and suspension joint. The connection is preloaded by applying an axial force to the actuating ring causing the locking ring to be expanded outwardly with the annular body becoming preloaded in compression and the suspension joint preloaded in tension with the preload force passing through the mating surfaces.

20 Claims, 12 Drawing Figures

WELLHEAD BODY LOCKDOWN AND METHOD FOR ENGAGING SAME

BACKGROUND OF THE INVENTION

This invention relates to a hydraulically actuated preloaded connection between an annular body and a suspension member and a method for establishing the connection. More specifically, the invention relates to a preloaded connection between a wellhead body and a suspension joint which provides extended service life.

A non-preloaded connection between two members is one in which the members are structurally connected but not rigidly joined. Externally applied tensile forces are reacted by the direct axial attachment between the members but externally applied bending and shear loads are reacted by a socket action between the members. A force couple is created if one member rotates and contacts the other. An example of a non-preloaded structural connection used in industry is the connection made between a typical subsea wellhead landed in a suspension joint. The suspension joint on a cemented well casing forms the axial attachment to react production riser tension loads. The bending and shear loads applied to the wellhead by the riser are transferred to the structural casing by a force couple created if the wellhead lower body rotates within and contacts the suspension joint.

A preloaded connection between two members is one in which the members are rigidly joined by preloading the two members that typically comprise the connection. One member is preloaded in tension and the other member is preloaded in compression with a compressive preload force passing through the mating surfaces. Unlike a non-preloaded connection which relies on relative movement between the two members to create a force couple used in reacting to external bending and shear loads, the initial compressive force in a preloaded connection holds the members in contact when external loads are applied. Examples of typical preloaded connections used in industry are a bolted flange, a clamp/hub and a marine hydraulic connector. In these examples, the bolts of a bolted flange connection, the clamps of a clamp/hub connection and the body of a marine hydraulic connector are initially preloaded in tension. This results in the flanges, clamp hubs and the wellhead or similar hub, respectively, being placed in compression with an initial preload force passing through the mating surfaces.

As separating loads are applied to a preloaded connection, the majority of these separating loads go to relieve the initial compressive preload force at the mating surfaces. The remainder of the separating loads are reacted by the members of the connection originally preloaded in tension. If the separating loads are sufficient to totally relieve the initial compressive preload force, the mating surfaces break contact and all loads are reacted by the tensile members of the connection. When this occurs, the connection acts as a non-preloaded connection.

Because a preloaded connection serves to limit the amount of load actually reacted by the tensile members in the connection, due to compressive stress relief, the tensile stresses rise less rapidly than stresses in similar members of a non-preloaded connection. In addition, the alternating stresses produced from cyclic loads will typically be less for a preloaded connection than a non-preloaded connection of the same geometry. Therefore, the fatigue life of the preloaded connection will be greater than the non-preloaded connection.

A subsea wellhead installation includes a number of concentric tubular members. The outer tubular member is the structural casing whose upper portion includes a suspension joint for supporting the wellhead body. This casing is typically 30 inches (762 mm) in diameter. The wellhead body typically includes a 20 inch (508 mm) casing welded to its lower portion. A number of smaller diameter concentric casing members are suspended from the inner bore of the wellhead body. In the prior art, a wellhead body is connected to a suspension joint by a non-preloaded or "socket" type connection. A wellhead for tension leg platforms may be required to withstand large external loads from drilling operations, ocean currents and storm conditions. If the wellhead is tied back to a vessel with a production riser, a large number of smaller amplitude cyclical fatigue loads must be withstood. Because the prior art wellhead body and suspension joint are not rigidly joined (preloaded), much of these loads are not directly transferred to the larger and stronger 30 inch (762 mm) casing. Instead, they are transferred into the 20 inch (508 mm) casing as the wellhead body rotates in its "socket". Accordingly, the stress from the external loads, particularly the large number of cyclical loads, can cause fatigue failure to the 20 inch (508 mm) casing suspended from the wellhead body.

It is known to use preloaded wellhead connectors utilizing split locking rings on subsea wellheads. However, these connectors require integral hydraulics to actuate the locking rings. These connectors must be bored for the hydraulic fluid passages, machined and include many components associated with the actuating mechanism.

I have determined that a preloaded connection can be used to connect an annular body to a suspension member by expanding a split ring between the annular body and the suspension member using an actuating ring. Integral hydraulics are not required in the connection to operate the actuating mechanism. When expanded by the actuating ring, the locking ring develops sufficient compressive preload force on the annular body and tensile preload force on the suspension member to maintain the mating surfaces together throughout the expected life of the annular body. Since the externally applied loads do not exceed the compressive preload, the external loads are transferred into the suspension members thereby reducing or eliminating chances for fatigue failure in the annular body or the casing there below. For example, a preloaded wellhead can now be expected to remain in service for its 30-year design life.

BRIEF SUMMARY OF THE INVENTION

This invention relates to a preloaded connection and method for supporting an annular body by an annular suspension member. The connection includes an actuating ring, a split locking ring and a retaining nut. The actuating ring is disposed around the annular body, the split locking ring is disposed around the actuating ring and the retaining nut is connected to the outside surface of the annular body below the actuating and locking rings. The locking ring is movable between a normally relaxed first condition and a second condition. The outside surface of the annular body includes a mating surface and a tapered support shoulder. The inside surface of the actuating ring has a mating surface and the outside surface of the actuating ring includes a tapered camming surface. The inside surface of the locking ring includes a tapered camming surface and the outside surface of the locking ring includes a tapered camming shoulder which merges into a mating surface. The locking ring further includes a lower stop surface and the outer surface of the locking ring includes an upper stop surface. The inside surface of the suspension member includes a tapered camming shoulder which merges into a mating surface. The suspension member further includes an upper stop surface and a tapered support shoulder. In the locking ring first condition, the camming surface of the locking ring is positioned between the camming surface of the actuating ring and the retaining nut and the camming shoulder of the locking ring is slightly offset with respect to the camming shoulder of the suspension member. Axial movement by the actuating ring relative to the locking ring expands the locking ring to its second condition and the camming shoulder of the locking ring transfers a tensile force to the suspension member.

The connection becomes mechanically locked when the camming surface of the actuating ring is axially displaced relative to the camming surface of the locking ring. Because the annular body is rigidly connected to the suspension member via the retaining nut and stop surfaces, the offset between the camming shoulder of the locking ring and the camming shoulder of the suspension member causes a tensile preload force to be transferred to the suspension member and a compressive preload force to be transferred to the annular body. This compressive preload force will exceed external maximum operating bending and shear loads so that these external loads will be transferred to the suspension member.

It is a principal object of my invention to form a connection to rigidly join an annular body to an annular suspension member without using integral hydraulics in the connection.

An advantage of my invention is that once a mechanical lock is formed, no net axial forces can cause the connection to unlock. External operating bending and shear loads are transferred from the annular body into the suspension member.

Another advantage of my invention is that alternating stresses produced by vibration or cyclic loading will be less than those for nonpreloaded connections. My connection is insensitive to vibration and cyclic loadings thereby increasing the fatigue life of my connection.

A further advantage of my invention is that the connection can be visually observed to insure a positive preloaded lockdown has been made.

The above and other objects, features and advantages of the invention will become apparent upon consideration of the detailed description and appended drawing.

DETAILED DESCRIPTION OF THE PREFERRED EMBODIMENT

Figure 1:
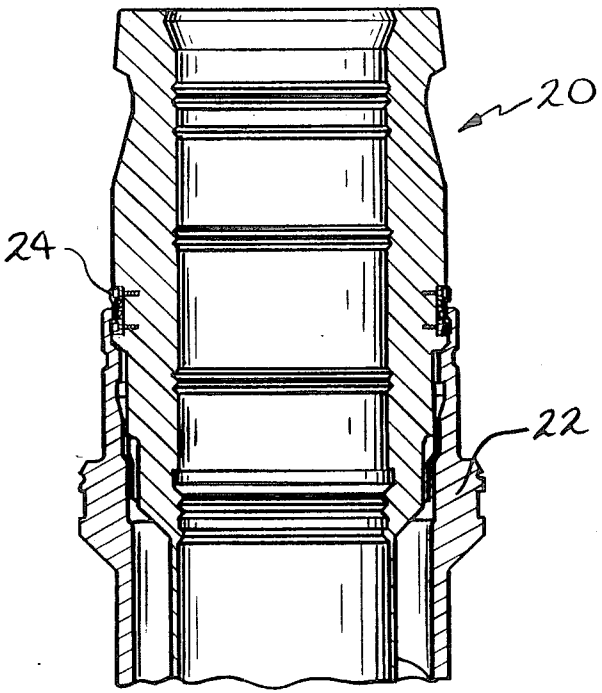
FIG. 1 PRIOR ART
FIG. 1 is a sectional view of prior art for connecting a wellhead body to a suspension joint.

FIG. 1 illustrates a prior art connection used to connect an annular body to a suspension joint. Reference numeral 20 refers to a wellhead body connected to a suspension joint 22 by non-preloaded locking segments 24. Externally applied tensile forces to wellhead body 20 will be reacted by the attachment to suspension joint 22 by locking segments 24. Externally applied bending and shear loads on wellhead body 20 will be reacted by a socket action if a portion of the outside surface of wellhead body 20 below locking segments 24 contacts the inside surface of suspension joint 22.

In a non-preloaded connection shown in FIG. 1, wellhead body 20 is not rigidly joined to suspension joint 22. Accordingly, much of the externally applied bending and shear loads are not transferred to suspension joint 22. This can result in premature fatigue failure between the wellhead body and its lower exending 20 inch (508 mm) casing.

It is known in the prior art to connect a member to an annular body using a preloaded connector including an actuating means and a split locking ring. However, these connectors are expensive to manufacture because they include bored hydraulic fluid passageways, machined hydraulic fluid chambers and several components requiring closely machined tolerances. Furthermore, because of their size, such connectors would not be practical for incorporation into a suspension joint in a 30 inch (762 mm) wellhead casing for connection with a wellhead body. Such a connector utilizing a split ring to connect a riser pipe to a blowout preventor is disclosed in U.S. Pat. No. 3,986,729 issued to William A. Taylor.

Figure 2:
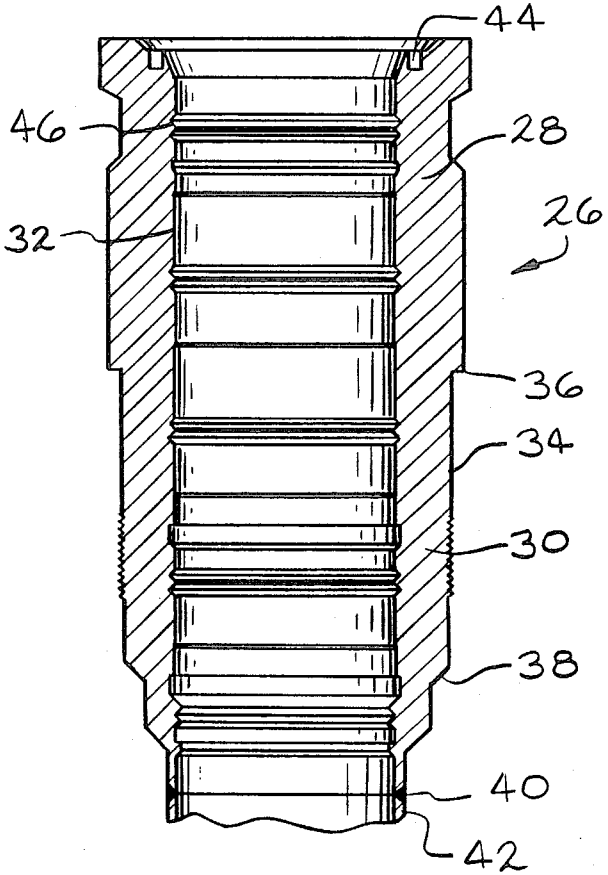
FIG. 2 is a sectional view of an annular body to be used in my invention.

Referring now to FIG. 2, reference numeral 26 generally refers to an annular body such as a subsea wellhead body which includes an upper portion 28 and a lower portion 30. Wellhead body 26 includes an inner through bore 32 including grooves 46. The upper surface of wellhead body 26 includes recesses 44. The function of grooves 46 and recesses 44 will be explained later. The outside surface of wellhead body 26 includes a right circular cylindrical mating surface 34. Hereinafter, right circular cylindrical surfaces will be referred to as straight surfaces. The upper porion of straight surface 34 merges into a stop surface 36. Lower portion 30 of wellhead body 26 includes a tapered support shoulder 38. Lower portion 30 merges into a 20 inch (508 mm) casing 42 which is welded to wellhead body 26 by a weld 40. Wellhead body 26 supports several smaller diameter concentric tubular members in a completed wellhead installation.

Figure 3:
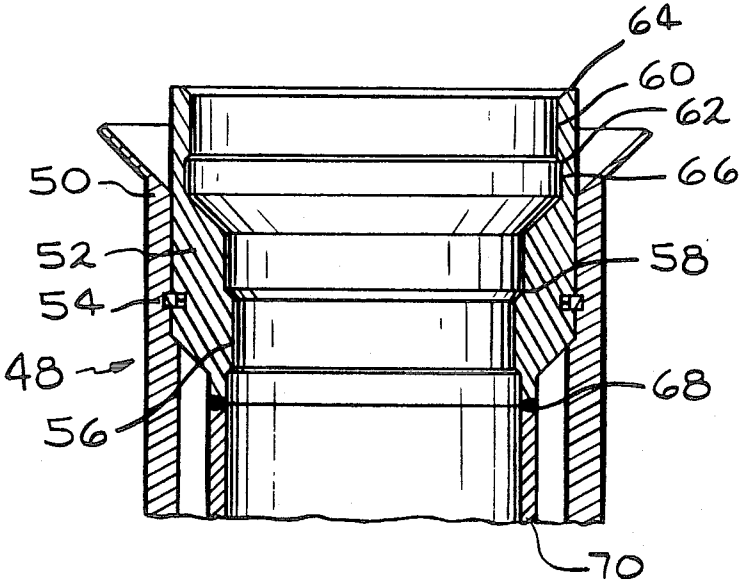
FIG. 3 is a sectional view of a suspension joint suspended in a wellhead receptacle.

Referring now to FIG. 3, reference numeral 48 generally illustrates a suspension member for supporting annular body 26 of FIG. 2. In the embodiment shown, suspension member 48 includes a well recepectacle or template 50 and a suspension joint 52 connected to receptacle 50 by locking segments 54. An inner bore 56 of suspension joint 52 merges into a tapered support shoulder 58. Inner bore 56 includes a straight mating surface 60 which merges into a tapered camming shoulder 62 which merges into another mating surface 66. Suspension joint 52 also includes an upper stop surface 64. Suspension joint 52 merges into a 30 inch (762 mm) casing 70 which is welded to suspension joint 52 by weld 68.

Figure 4:
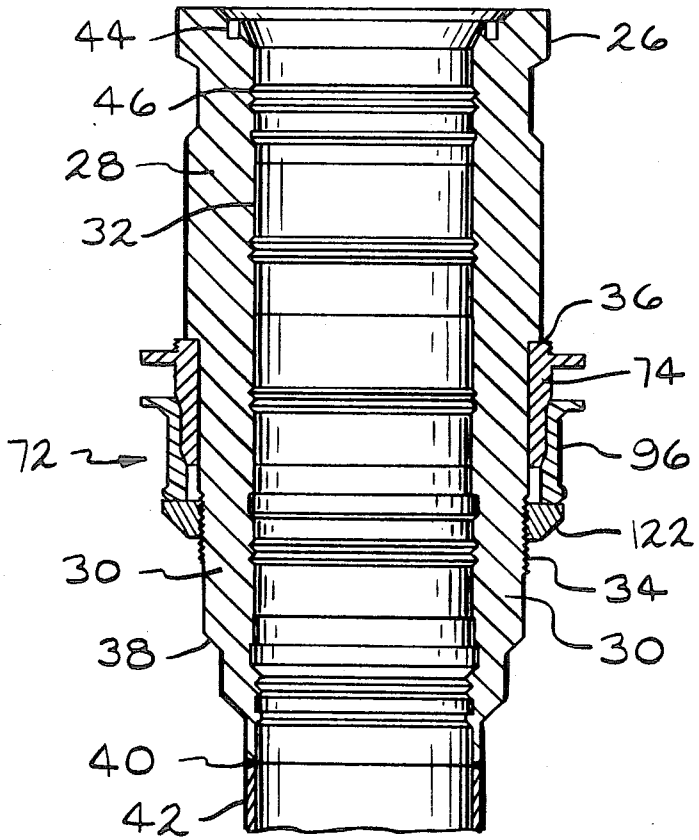
FIG. 4 is a sectional view of the annular body of FIG. 2 incorporating one embodiment of the connection for my invention.

Referring now to FIG. 4, reference numeral 72 generally refers to one embodiment of the connector used to preload annular body 26 shown in FIG. 2 to suspension member 48 shown in FIG. 3. Connector 72 includes an actuating ring 74, a locking ring 96 and a retaining nut 122. Hereinafter, by locking ring is meant a split locking ring that is movable from a normally relaxed first condition to an expanded second condition.

Figure 5:
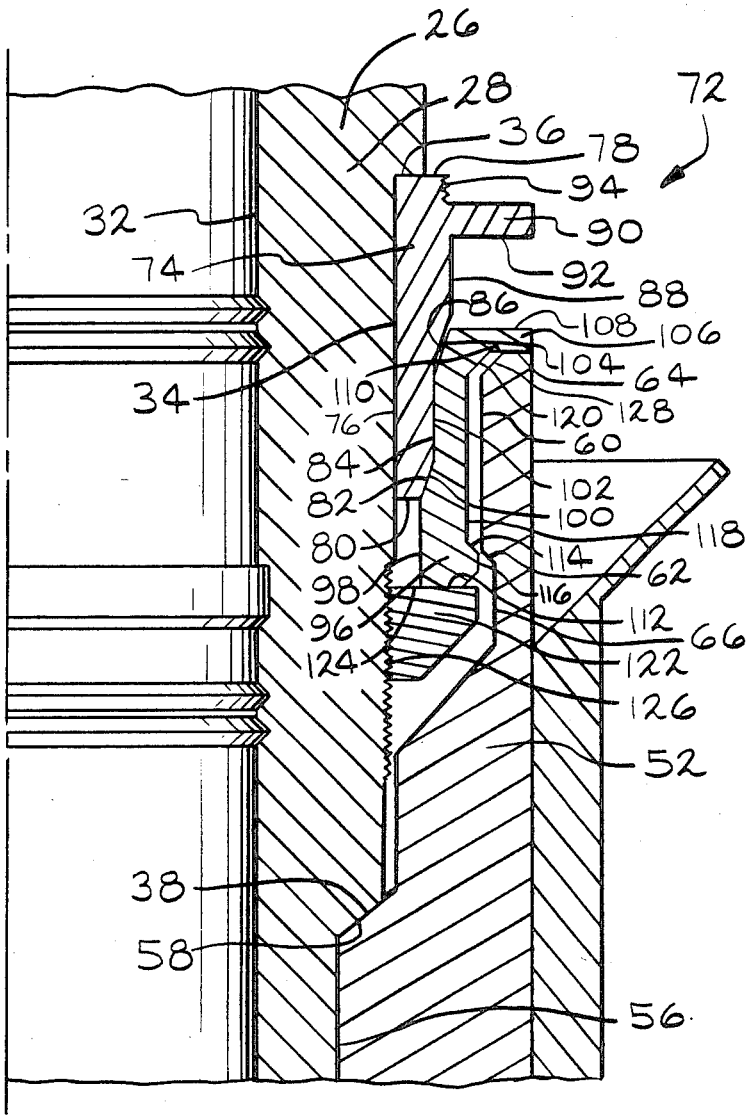
FIG. 5 is a sectional view of the annular body of FIG. 4 being received within the suspension member of FIG. 3 before the connection is preloaded.

FIG. 5 provides further details of the connector shown in FIG. 4. Actuating ring 74 includes a straight inner mating surface 76 substantially the same diameter or slightly larger than surface 34 of wellhead body 26. Actuating ring 74 includes an upper stop surface 78 and a lower stop surface 80. The outside surface of actuating ring 74 includes a tapered camming surface 82 which merges into a straight surface 84 which merges into another tapered camming surface 86. Camming surface 86 merges into a straight surface 88 which merges into an outwardly projecting flange 90. Flange 90 includes a lower stop surface 92. The outer surface of actuating ring 74 includes a threaded portion 94 between stop surface 78 and flange 90.

The inside surface of locking ring 96 includes a straight surface 98 which merges into a tapered camming surface 100. Camming surface 100 merges into a straight surface 102 which merges into a tapered camming surface 104. Camming surface 104 merges into an outwardly projecting flange 106 which includes an upper stop surface 108 and a lower stop surface 110. The outside surface of locking ring 96 includes a tapered camming shoulder 114 and a mating surface 116. Camming shoulder 114 merges into a straight surface 118 which merges into a tapered mating surface 120.

Retaining nut 122 has an inner diameter substantially the same or slightly larger than surface 34 of wellhead body 26. Retaining nut 122 includes an upper stop surface 124 and has an inner threaded bore 126 for attachment to surface 34 of wellhead body 26.

Connector 72 in FIG. 5 is in a non-preloaded, unlocked condition. Locking ring 96 is in its retracted (relaxed) first condition wherein camming surface 82 of actuating ring 74 is positioned above camming surface 100 of locking ring 96. In this first condition, surface 84 of actuating ring 74 is positioned opposite surface 102 of locking ring 96. An important feature of my invention is the axial offset shown between camming shoulders 62 and 114. In its first condition, camming shoulder 114 of locking ring 96 is offset slightly upwardly with respect to camming shoulder 62 of suspension joint 52.

Figure 6:
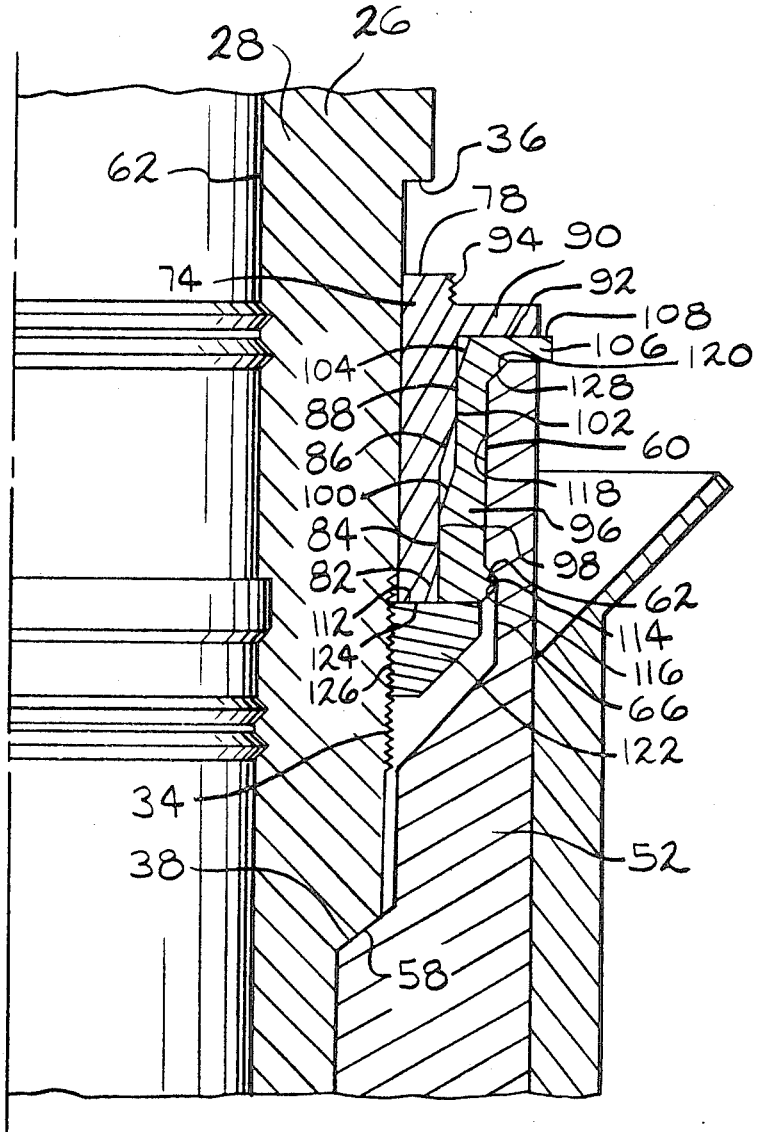
FIG. 6 is a sectional view of the annular body of FIG. 4 being landed in the suspension member of FIG. 3 and the connection having been preloaded.
Figure 7:
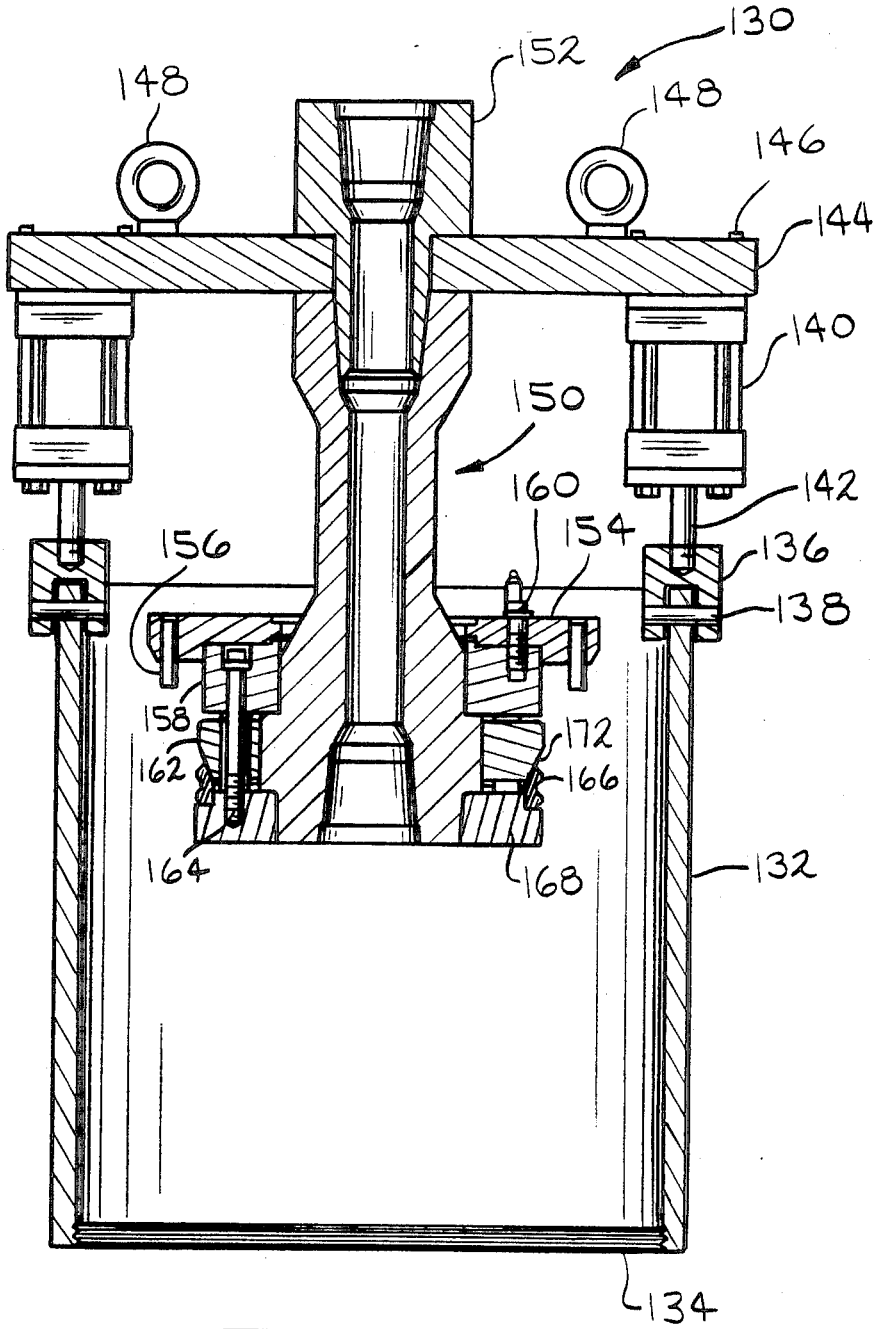
FIG. 7 is a sectional view of a running tool to land the annular body of FIG. 4 into the suspension member shown in FIG. 3.

The preloaded connection is established between annular body 26 and suspension member 48 by the axial displacement of actuating ring 74 with respect to locking ring 96 as shown in FIG. 6. Camming surface 82 of actuating ring 74 is moved past camming surface 100 of locking ring 96. Straight surfaces 84 and 88 of actuating ring 74 become engaged with straight surfaces 98 and 102, respectively of locking ring 96. As illustrated in FIG. 5, wellhead body 26 is initially supported by suspension joint 52 by landing support shoulder 38 of wellhead body 26 onto support shoulder 58 of suspension joint 52. Since retaining nut 122 is connected to surface 34 of wellhead body 26, camming shoulder 114 of locking ring 96 transfers an upward tensile force into offset camming shoulder 62 of suspension joint 52 as mating surface 116 of locking ring 96 is caused to engage with mating surface 66 of suspension joint 52. The axial displacement of actuating ring 74 displaces locking ring 96 into an expanded or second condition wherein suspension joint 52 is placed in hoop tension and wellhead body 26 in ring compression. The compressive force applied to wellhead body 26 exceeds maximun externally applied bending and shear loads to wellhead body 26 so that these loads will be transferred to suspension joint 52.

For forming connector 72 on subsea wellhead body 26, assembly normally occurs at a surface facility (not shown) such as a drilling platform. Before casing 42 is welded to lower portion 30, actuating ring 74 is placed onto wellhead body 26 from the lower end by passing over lower portion 30. Locking ring 96 is then passed over lower portion 30 and then passed over actuating ring 74 until contact is made. Retaining nut 122 is finally passed over lower portion 30 and preferbly threadably connected to partially threaded wellhead body surface 34 and adjusted to a preset distance from support shoulders 38, 58 and preferably stop surface 124 of retaining nut 122 contacts stop surface 112 of locking ring 96. Preferably, retaining nut 122 is tightened to the preset distance from support shoulders 38 and 58 so that stop surface 78 of actuating ring 74 engages stop surface 36 of wellhead body 26. Camming surfaces 100 and 104 of locking ring 96 would preferably engage camming surfaces 82 and 86 respectively on actuation ring 74 as shown in FIG. 5.

Figure 12:
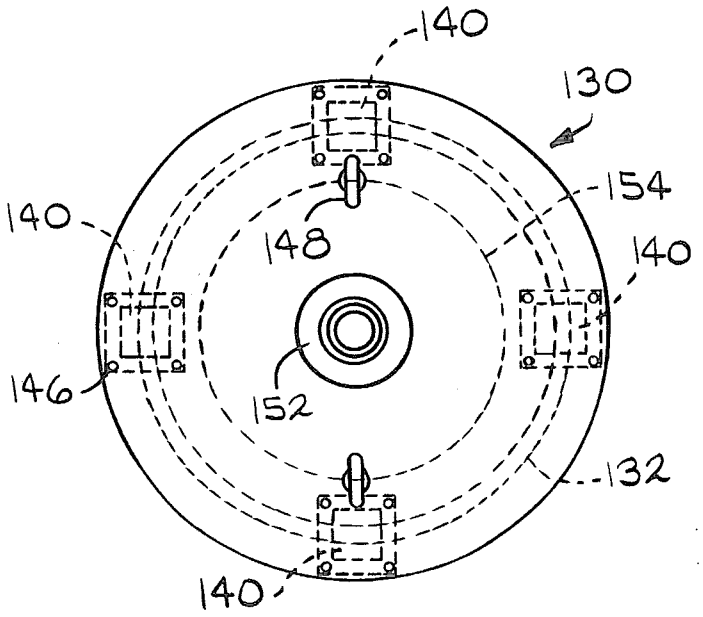
FIG. 12 is a top view of the running tool shown in FIG. 7.

For subsea wellheads, the annular body will be installed remotely from a surface facility. A running tool 130 such as illustrated in FIGS. 7, 8, 9 and 10 may be used for landing assembled wellhead body 26 of FIG. 4 into suspension joint 48 of FIG. 3. Running tool 130 includes four hydraulic cylinders 140 (see FIG. 12) mounted to a base plate 144 by fasteners 146. Hydraulic cylinders 140 are connected to an actuating cylinder 132 by a piston rod 142 and a celvis 136. Clevis 136 is connected to actuating cylinder 132 by a pin 138. The lower inside surface of actuating cylinder 132 includes an acme thread 134 for connecting to upper outside surface 94 of actuating ring 74 if it is desirable to remove wellhead body 26 from suspension joint 52 at a later date.

An inner body 150 of running tool 130 includes a drill pipe adapter 152, a supporting plate 154, locating pins 156 and an upper ring 158 mounted to plate 154 by fasteners 160. Upper ring 158 supports a lower ring 168 by bolts 164. Ring 168 supports a camming ring 162 which includes an outer tapered or camming surface 172. A support ring 166 is positioned above ring 168 and outwardly of camming surface 172.

Figure 8:
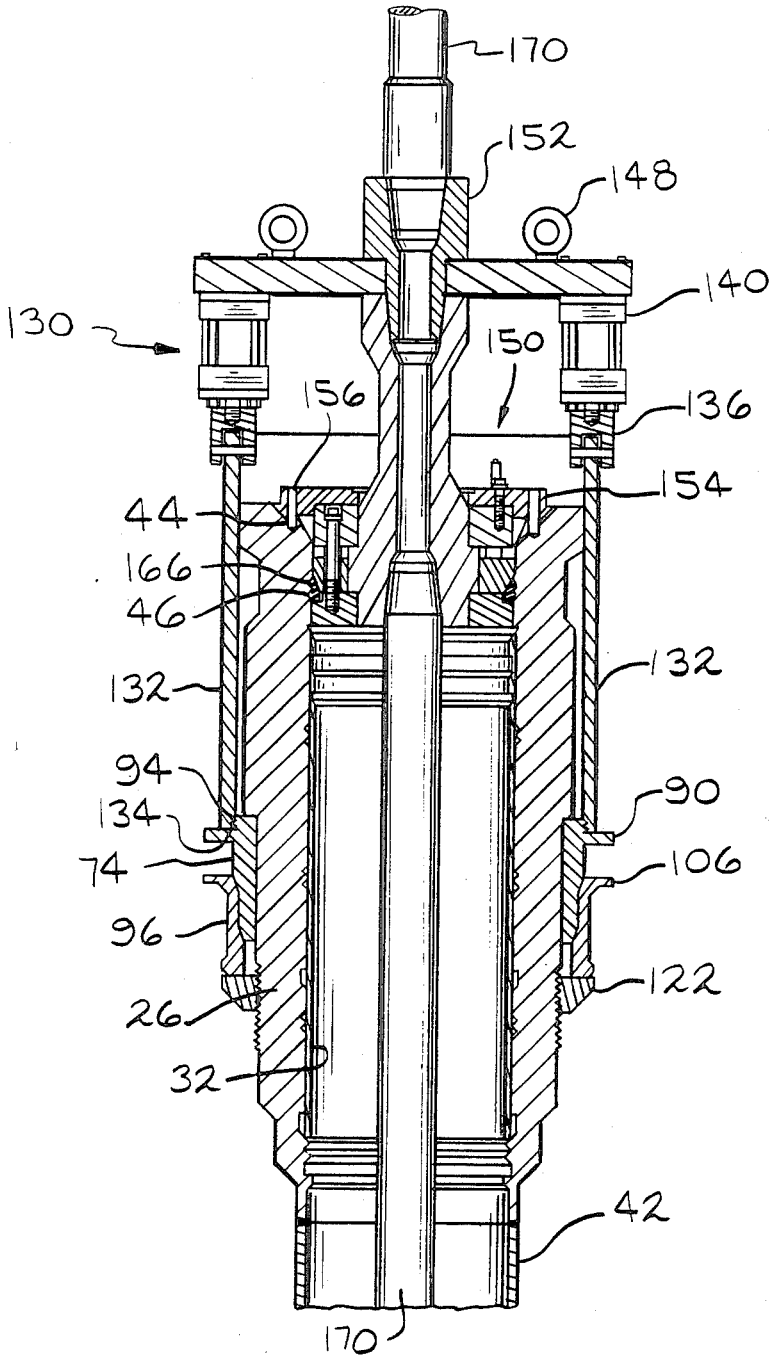
FIG. 8 is a sectional view of the annular body of FIG. 4 connected to the running tool of FIG. 7.

After connector 72 has been assembled to wellhead body 26 running tool 130 is connected to wellhead body 26 as illustrated in FIG. 8. Landing of support ring 166 into grooves 46 provides a positive connection between wellhead body 26 and running tool 130 so that wellhead body 26 may be remotely landed by using a drill pipe 170 connected to running tool 30 by adapter 152.

Figure 9:
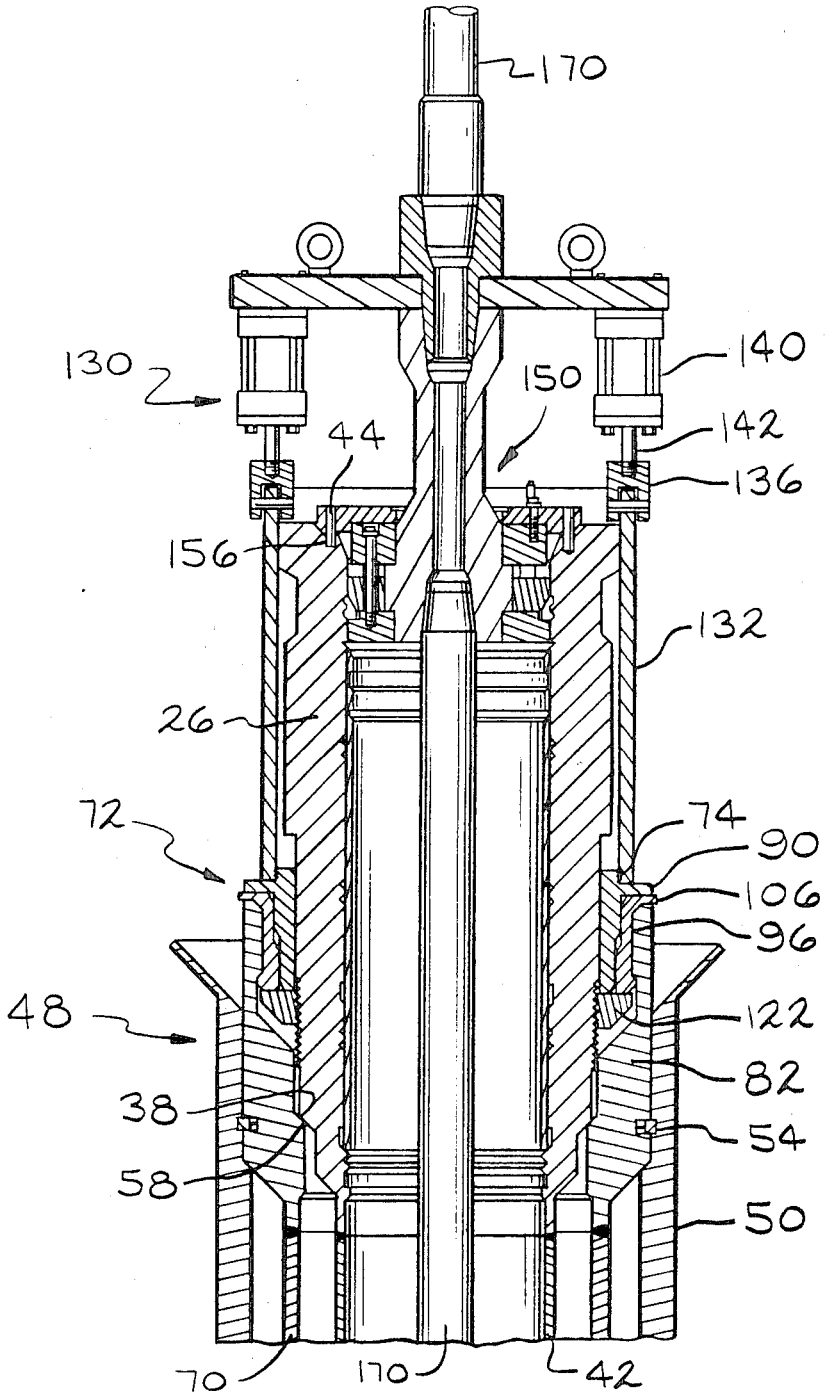
FIG. 9 is a sectional view of the annular body in FIG. 4 having been preloaded into the suspension member of FIG. 3 using the running tool in FIG. 7.
Figure 10:
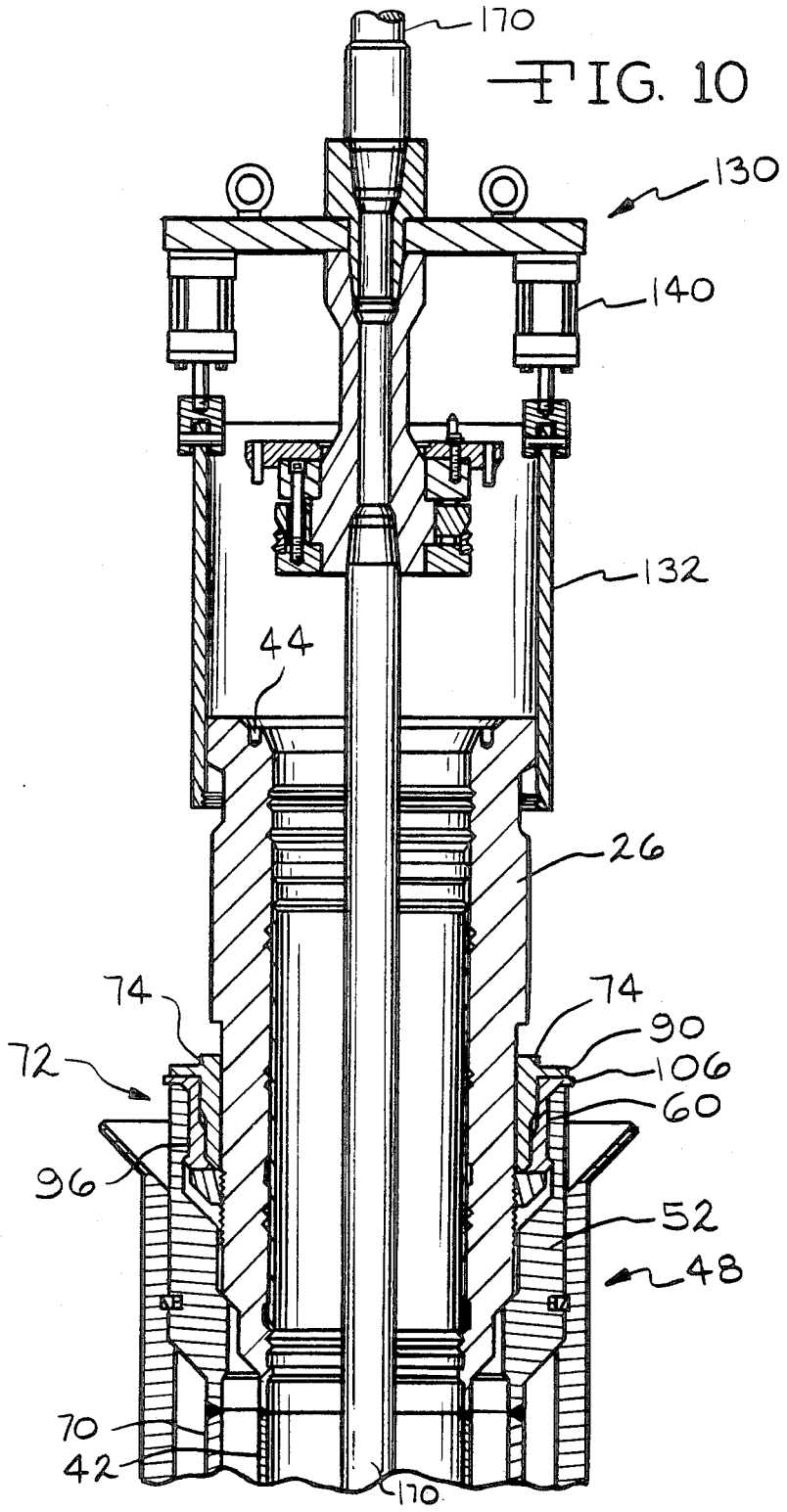
FIG. 10 is a sectional view showing the running tool being disengaged from the annular body.

When inner body 150 of running tool 130 is connected to wellhead body 26, the lower surface of actuating cylinder 132 threadably engages the upper outside surface of flange 90 of actuating ring 74 as shown in FIG. 8. Wellhead body 26 is lowered using drill pipe 170 and landed into suspension joint 52. After landing, hydraulic cylinders 140 are remotely energized from the surface facility through hydraulic lines (not shown) wherein piston rod 142 drives actuating cylinder 132 downwardly applying force to actuating ring 74. Sufficient force is applied until camming surface 82 of actuating ring 74 is moved past camming surface 100 of locking ring 96. This causes locking ring 96 to be displaced from a relaxed first condition into an expanded second condition to tightly engage inside surface 60 of suspension joint 52 as shown in FIGS. 6 and 9. After locking ring 96 has been displaced into the second condition, running tool 130 is removed as shown in FIG. 10.

Although hydraulic actuating means such as cylinders 140 could be permanently mounted onto the upper surface of actuating ring 74, it is preferred to mount them onto running tool 130. By mounting on running tool 130, the hydraulic seals are not exposed to sea water for long periods of time and are easily accessible for service.

As illustrated in FIGS. 5 and 8, the outside diameter of flange 106 of locking ring 96, with locking ring 96 in its relaxed condition, preferably will not exceed the outside diameter of flange 90 of actuating ring 74. When the connection has been properly locked as shown in FIGS. 6, 9 and 10, flange 106 of locking ring 96 extends outwardly of flange 90 of actuating ring 74. For remote installation such as for a subsea wellhead body, a television camera can be positioned adjacent the connection for observing whether positive lockdown has been made.

It may be desirable to inspect, service and ultimately abandon the wellhead body at a later date. To remove the wellhead body, the preloaded connection may be unlocked by applying an axial force to the actuating ring that is opposite in direction to the force applied for locking. This force must overcome the frictional forces developed between the locking ring inner surfaces which are bearing against the outer surfaces of the actuating ring and the actuating ring inner surfaces which are bearing against the outer surface of the wellhead body. The wellhead body may be removed by remotely lowering and landing the running tool as previously described. Of course, the inside diameter of cylinder 132 would equal the outside diameter of actuating ring 74 at portion 94. Cylinder 132 would be connected to actuating ring 74 by rotating running tool 130. Primarily, hydraulic cylinders 140 may be energized to withdraw actuating ring 74 thereby removing the preload. Alternatively, drill pipe 170 connected to running tool 130 can apply sufficient upward force to free actuating ring 74.

Figure 11:
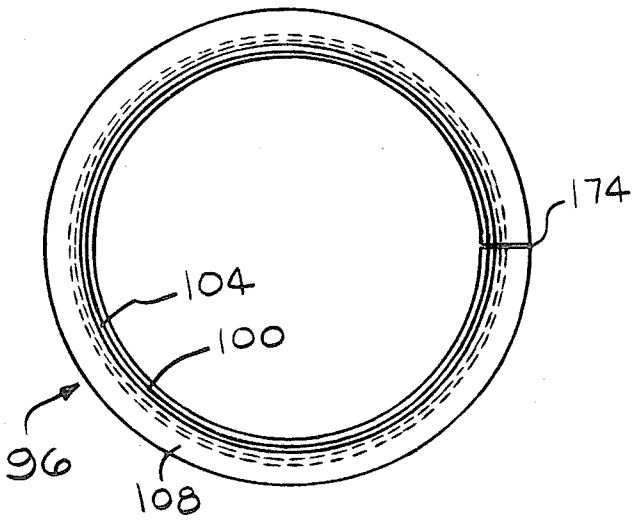
FIG. 11 is a top view of one embodiment of the locking ring used in my invention.

As explained above, locking ring 96 must be movable between a first and a second condition when expanded by actuating ring 74. It is well known to make steel rings expandable by providing a cut through the ring such as saw cut 174 shown in FIG. 11.

The locking frictional engagement surfaces between the wellhead body, actuating ring, locking ring and suspension joint shown in the embodiment are preferably all straight or vertical surfaces. Threaded members or tapered surfaces could be used. However, threaded members require rotation which is difficult at most subsea depths. Threads may deteriorate over long periods of time, particularly in seawater which would cause difficulty in releasing the connection. Self-locking tapers on wedging surfaces would be susceptible to loss of preload due to vibration.

The straight surfaces are preferred because they constitute a mechanical lock. There are no net vertical forces acting on the locking ring to cause the connector to unlock. The mechanical lock is virtually insensitive to vibration. Radial friction forces produced by the actuating ring bearing against the locking ring resist upward movement. This reduces the possibility of the actuating ring moving upwardly by a "racheting" effect produced by external cyclic loadings on the wellhead body.

While only one embodiment of my invention has been described, it will be understood various modifications can be made to my invention without departing from the scope and spirit of it. Therefore, the limits of my invention should be determined from the appended claims.

I claim:

1. The combination comprising:

an annular suspension member having a through bore including a tapered camming shoulder merging into a mating surface, a tapered support shoulder and an upper stop surface, an annular body having an outer mating surface and a tapered support shoulder, and a preloaded connection having an actuating ring including an inner mating surface and an outer surface including a tapered camming surface, said actuating ring disposed around said mating surface of said annular body, a split locking ring capable of being moved from a normally relaxed first condition to an expanded second condition, said locking ring including a tapered inside camming surface, said locking ring including a tapered cammimg shoulder on its outside surface which merges into a mating surface, said locking ring including an upper and a lower stop surface, said locking ring disposed between said actuating ring and said suspension member, a retaining nut having a through bore and an upper stop surface, said retaining nut being disposed around said annular body below said actuating and locking rings, said retaining nut being connected to said annular body and positioned with said upper stop surface of said retaining nut in engagement with said lower stop surface of said locking ring so that said camming shoulder of said locking ring is slightly offset with respect to said camming shoulder of said suspension member when said locking ring is in said first condition, said camming shoulder of said locking ring transferring a tensile force to said suspension member as said camming surface of said actuating ring is axially displaced relative to said camming surface of said locking ring when said locking ring is in said second condition.

2. The connection as set forth in claim 1 wherein said camming surface of said actuating ring merges into a first straight surface, said camming surface of said locking ring merges into a first straight surface, said camming surface of said locking ring being positioned between said camming surface of said actuating ring and said retaining nut when said locking ring is in said first condition, said camming surface of said actuating ring being between said camming surface of said locking ring and said retaining nut when said locking ring is in said second condition.

3. The connection as set forth in claim 2 wherein said outer surface of said actuating ring includes a second straight surface, said inside surface of said locking ring includes a second straight surface, said first surface of said actuating ring being in engagement with said second surface of said locking ring when said locking ring is in said first condition and said first surface of said actuating ring being in engagement with said first surface of said locking ring when said locking ring is in said second condition.

4. The connection as set forth in claim 3 wherein said first surface of said actuating ring merges into a second tapered camming surface, said second surface of said locking ring merges into a second tapered camming surface.

5. The connection as set forth in claim 4 wherein said second surface of said actuating ring merges into an outwardly projecting annular flange, said second camming surface of said locking ring merges into an outwardly projecting annular flange, the outer diameter of said flange of said locking ring when said locking ring is in said first condition not to exceed the outer diameter of said flange of said actuating ring, whereby when said locking ring is in said second condition said flange of said locking ring extends outwardly of said flange of said actuating ring.

6. The connection as set forth in claim 1 wherein said mating surfaces of said annular body and said actuating ring are straight surfaces.

7. The connection as set forth in claim 1 wherein said mating surfaces of said locking ring and said suspension member are straight surfaces.

8. The connection as set forth in claim 7 wherein said camming shoulder of said locking ring and said camming shoulder of said suspension member both merge in second straight mating surfaces.

9. The connection as set forth in claim 1 wherein said actuating ring includes an upper stop surface, said annular body includes a stop surface, said upper stop surface of said actuating ring contacting said stop surface of said annular body when said locking ring is in said first condition.

10. The connection as set forth in claim 1 wherein said annular body is a subsea wellhead body.

11. The combination comprising:

an annular suspension joint having a through bore including a tapered camming shoulder merging into a straight surface, a tapered support shoulder and an upper stop surface, a wellhead body having an outer surface including a straight surface and a tapered support shoulder, and a preloaded connection having an actuating ring having a straight inner surface of a diameter no less than that of said surface of said wellhead body, said actuating ring being disposed around said surface of said wellhead body, the outer surface of said actuating ring including a tapered camming surface which merges into a straight surface, a split locking ring positioned between said actuating ring and said suspension joint, the inner surface of said locking ring including a straight surface which merges into a tapered camming surface, the outer surface of said locking ring includes a tapered camming shoulder which merges into a straight surface, said locking ring including upper and lower stop surfaces, a retaining nut which is threadably connected to said surface of said wellhead body, said retaining nut positioned below said stop surface of said locking ring, said retaining nut including an upper stop surface in engagement with said lower stop surface of said locking ring, said locking ring being movable between a normally relaxed first condition and an expanded second condition, said camming shoulder of said locking ring being slightly offset with respect to said camming shoulder of said suspension joint when said locking ring is in said first condition, and said camming surface of said actuating ring being axially displaced relative to said camming surface of said locking ring when said locking ring is in said second condition.

12. The connection as set forth in claim 11 wherein said straight outer surface of said actuating ring merges into a second tapered camming surface, said second camming surface merges into a second straight surface, said camming surface of said locking ring merges into a second straight surface, said second straight surface of said locking ring merges into a second tapered camming surface.

13. The connection as set forth in claim 12 wherein said second outer surface of said actuating ring merges into an outwardly projecting annular flange, said second camming surface of said locking ring merges into an outwardly projecting annular flange, the outer diameter of said flange of said locking ring when said locking ring is in said first condition not to exceed the outer diameter of said flange of said actuating ring, whereby when said locking ring is in said second condition said flange of said locking ring extends outwardly of said flange of said actuating ring.

14. A method of forming a preloaded connection for supporting an annular body by an annular suspension member using an actuating ring, a split locking ring, and a retaining nut; the outer surface of the annular body including a mating surface and a tapered support shoulder, the through bore of the suspension member including a tapered camming shoulder which merges into a mating surface and a tapered support shoulder, the actuating ring includes an inner surface and an outer tapered camming surface, the locking ring includes an inner tapered camming surface, an outer tapered camming shoulder which merges into a mating surface, and a lower stop surface, the retaining nut includes an upper stop surface, comprising the steps of:

positioning the actuating ring over the outer surface of the annular body, positioning the locking ring in a relaxed first condition over the outer surface of said actuating ring, positioning the retaining nut around said outer surface of said annular body and connecting said retaining nut to said annular body so that the upper stop surface of the retaining nut engages the lower stop surface of the locking ring, landing said annular body into said through bore of said suspension member wherein the support shoulder of said annular body engages the support shoulder of said suspension member and the camming shoulder of said locking ring in said first condition is slightly offset with respect to the camming shoulder of said suspension member, and applying an axial force to said actuating ring until said mating surfaces of said locking ring and said suspension member are engaged whereby a tensile force is transferred into said suspension member by said camming shoulder of said locking ring as said locking ring is moved to a second condition.

15. The method as set forth in claim 14 wherein the outer surface of said actuating ring includes a first straight surface and the inner surface of said locking ring includes a first straight surface, the step of engaging said first surface of said locking ring by said first surface of said actuating ring when said locking ring is in said second condition.

16. A method as set forth in claim 15 wherein said outer straight surface of said actuating ring merges into a second tapered camming surface and said second camming surface merges into a second straight surface, said camming surface of said locking ring merges into a second straight surface and said second straight surface of said locking ring merges into a second tapered camming surface.

17. A method as set forth in claim 16 wherein said second straight surface of said actuating ring merges into an outwardly projecting annular flange, said second camming surface of said locking ring merges into an outwardly projecting annular flange, the outer diameter of said flange of said locking ring when said locking ring is in said first condition not to exceed the outer diameter of said flange of said actuating ring, the step of expanding said locking ring into said second condition whereby said flange of said locking ring extends outwardly of said flange of said actuating ring indicating a positive mechanical lock.

18. The method as set forth in claim 14 wherein said annular body is a subsea wellhead body having a through bore, positioning said actuating and locking rings and said retaining nut onto said wellhead body at a surface facility, attaching a running tool to said through bore of said wellhead body, said running tool including an actuating cylinder having a through bore, vertically lowering said wellhead body and landing into said suspension member, remotely energizing said actuating cylinder to engage and axially displace said actuating ring to apply said axial force, detaching said running tool from said through bore of said wellhead body after said locking ring is in said second condition.

19. A method as set forth in claim 18 wherein said outer surface of said actuating ring and the inner surface of said actuating cylinder include a threaded portion, vertically lowering said running tool to said preloaded wellhead body and rotatably connecting said actuating cylinder to said actuating ring, applying sufficient upward axial force on said actuating ring whereby said locking ring is allowed to retract to said first condition.

20. A method of forming a preloaded connection without using integral hydraulics for supporting a subsea wellhead body by an annular suspension joint using an actuating ring, a split locking ring and a retaining nut; the outer surface of the wellhead body including a straight surface at least a portion of which is threaded and a tapered support shoulder, the inner bore of the suspension joint including a tapered camming shoulder which merges into a straight surface and a tapered support shoulder, the actuating ring including a straight inner surface of a diameter at least as great as that of the straight surface of the wellhead body and an outer tapered camming surface which merges into a straight surface, the locking ring inner surface including a straight surface which merges into a tapered camming surface and an outer surface which includes a tapered camming shoulder which merges into a straight surface, the locking ring including upper and lower stop surfaces, the retaining nut including an upper stop surface and the inner surface of the retaining nut being threaded and of substantially the same diameter as the straight surface of the wellhead body, comprising the steps of:

positioning the actuating ring over the straight surface of the wellhead body, positioning the locking ring in a relaxed first condition over the outer straight surface of said actuating ring, threadably connecting the retaining nut to the threaded portion of said wellhead body so that the upper surface of the retaining nut engages the lower stop surface of the locking ring, attaching a running tool to said wellhead body, lowering and landing said wellhead body into the inner bore of the suspension joint wherein said support shoulder of said wellhead body engages said support shoulder of said suspension joint and the camming shoulder of said locking ring is slighly upwardly offset with respect to the camming shoulder of said suspension joint, applying an axial force to said actuating ring causing a downward axial displacement of said actuating ring such that at least a portion of the camming surface on said actuating ring moves past the camming surface on said locking ring thereby causing said camming shoulder of said locking ring to engage and transfer a tensile force into said camming shoulder of said suspension joint as said locking ring is expanded to a second condition.

* * * * *